US009099033B2

(12) United States Patent
Son et al.

(10) Patent No.: US 9,099,033 B2
(45) Date of Patent: Aug. 4, 2015

(54) ORGANIC ELECTROLUMINESCENT DISPLAY AND METHOD OF DRIVING BASED ON PLURALITY OF OPERATING ENVIRONMENTAL FACTORS

(75) Inventors: Ji-Yun Son, Yongin (KR); Wook Lee, Yongin (KR); Sung-Cheon Park, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 285 days.

(21) Appl. No.: 13/033,522

(22) Filed: Feb. 23, 2011

(65) Prior Publication Data

US 2011/0205202 A1 Aug. 25, 2011

(30) Foreign Application Priority Data

Feb. 24, 2010 (KR) ..... 10-2010-0016670

(51) Int. Cl.
*G09G 3/30* (2006.01)
*G09G 3/32* (2006.01)

(52) U.S. Cl.
CPC ..... *G09G 3/3208* (2013.01); *G09G 2320/041* (2013.01); *G09G 2320/0626* (2013.01); *G09G 2360/144* (2013.01); *G09G 2360/16* (2013.01)

(58) Field of Classification Search
CPC ..... G09G 3/3208; G09G 2320/041; G09G 2360/144
USPC ..... 345/87–103, 204–215, 690–693
See application file for complete search history.

(56) References Cited

U.S. PATENT DOCUMENTS

| | | | | |
|---|---|---|---|---|
| 7,460,092 | B2 | 12/2008 | Choi et al. | |
| 2003/0193472 | A1 * | 10/2003 | Powell | 345/102 |
| 2005/0140606 | A1 * | 6/2005 | Choi et al. | 345/76 |
| 2007/0018933 | A1 * | 1/2007 | Lee | 345/98 |
| 2008/0055205 | A1 * | 3/2008 | Chung et al. | 345/76 |
| 2008/0074361 | A1 * | 3/2008 | Lee et al. | 345/77 |

FOREIGN PATENT DOCUMENTS

| | | | |
|---|---|---|---|
| JP | 03-140029 | A | 6/1991 |
| KR | 10-2003-0058768 | A | 7/2003 |
| KR | 10-2005-0037126 | A | 4/2005 |
| KR | 10-2005-0051353 | A | 6/2005 |
| KR | 10-0620848 | B1 | 8/2006 |
| KR | 10-2007-0008872 | A | 1/2007 |
| KR | 10-2008-0020355 | A | 3/2008 |
| KR | 10-2008-0028222 | A | 3/2008 |
| KR | 10-2008-0062131 | A | 7/2008 |

OTHER PUBLICATIONS

Korean Registration Determination Certificate dated Aug. 29, 2011 for Korean Patent Application No. KR 10-2010-0016670 which corresponds to captioned U.S. Appl. No. 13/033,522.

* cited by examiner

*Primary Examiner* — Charles V Hicks
*Assistant Examiner* — Charles Zheng
(74) *Attorney, Agent, or Firm* — Knobbe Martens Olson & Bear LLP

(57) ABSTRACT

A method and system for controlling power consumption of a display is disclosed. The method includes determining battery voltage, brightness of ambient light, temperature, and adjusting the brightness of the organic electroluminescent display apparatus, or by adjusting the voltage difference between a first power voltage and a second power voltage of the organic electroluminescent display apparatus, according to the battery voltage, the brightness of the ambient light, the temperature, and image data of the organic electroluminescent display apparatus.

18 Claims, 7 Drawing Sheets

ORGANIC ELECTROLUMINESCENT DISPLAY AND METHOD OF DRIVING BASED ON PLURALITY OF OPERATING ENVIRONMENTAL FACTORS

CROSS-REFERENCE TO RELATED APPLICATIONS

This application claims the benefit of Korean Patent Application No. 10-2010-0016670, filed on Feb. 24, 2010, in the Korean Intellectual Property Office, the disclosure of which is incorporated herein in its entirety by reference.

BACKGROUND

1. Field

The disclosed technology relates to an organic electroluminescent display apparatus and a method of driving the same.

2. Description of the Related Technology

Various flat panel display devices are being developed to overcome the weight and size disadvantages of a cathode ray tube. Examples of flat panel display devices include liquid crystal display devices, field emission display devices, plasma display panels, and organic electroluminescent display devices.

Organic electroluminescent display devices display images using Organic Light Emitting Diodes (OLEDs) that emit light through recombination of electrons and holes. Because organic electroluminescent display devices have various advantages such as being thin and good color reproduction, they are increasingly being used in various devices such as televisions, portable phones, Personal Digital Assistants (PDAs), MPEG Audio Layer-3 (MP3) players, and digital cameras.

SUMMARY OF CERTAIN INVENTIVE ASPECTS

One inventive aspect is a method of driving an organic electroluminescent display apparatus. The method includes detecting a voltage of a battery that supplies power to the organic electroluminescent display apparatus, detecting a brightness of ambient light, and detecting a temperature of the organic electroluminescent display apparatus. The method also includes controlling at least one of a brightness of the organic electroluminescent display apparatus and a voltage difference between a first power voltage and a second power voltage that are supplied to pixels of the organic electroluminescent display apparatus, where the at least one of the brightness and the power voltage difference are controlled according to the battery voltage, the brightness of the ambient light, the temperature, and image data of the organic electroluminescent display apparatus.

Another inventive aspect is an organic electroluminescent display apparatus including a plurality of pixels disposed near intersections between data lines and scan lines, a gate control unit configured to output scan signals through the scan lines to the pixels and to output an emission control signal through emission control lines to the pixels, and a data drive unit configured to generate a data signal corresponding to image data and to output the data signal through the data lines to the pixels. The display apparatus also includes a battery voltage detecting unit configure to detect a voltage of a battery that supplies power to the organic electroluminescent display apparatus, a power supply unit configured to generate and output a first power voltage and a second power voltage to the pixels, an external light detecting unit configured to detect a brightness of ambient light, and a temperature detecting unit configured to detect a temperature of the organic electroluminescent display apparatus. The display apparatus also includes a power voltage control unit configured to control at least one of a brightness of the organic electroluminescent display apparatus and a voltage difference between the first power voltage and the second power voltage according to the battery voltage, the brightness of the ambient light, the temperature, and the image data.

BRIEF DESCRIPTION OF THE DRAWINGS

The above and other features and advantages of exemplary embodiments are described below with reference to the attached drawings in which.

DETAILED DESCRIPTION OF CERTAIN INVENTIVE EMBODIMENTS

Figure 1:
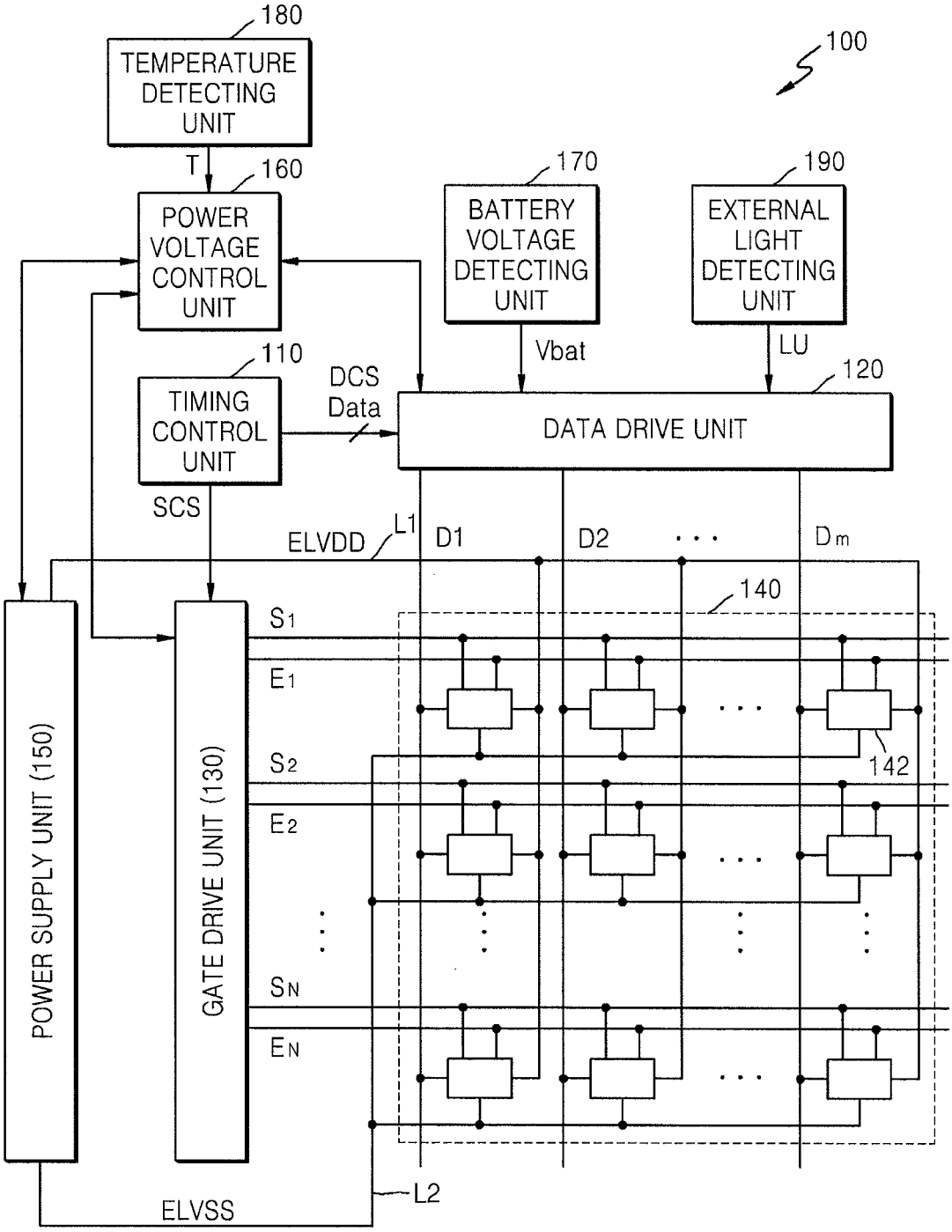
FIG. 1 is a schematic diagram illustrating an organic electroluminescent display apparatus according to an embodiment.

Various inventive aspects of exemplary embodiments are illustrated in the drawings and are described herein. However, the description does not limit the present invention to the specific embodiments described, and it should be understood that various modifications, equivalents, and replacements are contemplated. Moreover, some detailed descriptions related to well-known functions or configurations are not included in order not to unnecessarily obscure subject matter of various inventive concepts.

In the following description, the technical terms are used only for explaining various aspects of specific exemplary embodiments while not being limiting. The terms of a singular form may include plural forms unless mentioned specifically. The meaning of 'comprises' and/or 'comprising' specifies a property, a region, a fixed number, a step, a process, an element and/or a component but does not exclude other properties, regions, fixed numbers, steps, processes, elements and/or components.

Certain inventive aspects may be represented with functional block configurations and various processing steps. These functional blocks may be realized with a different number of hardware or/and software components for executing specific functions. For example, embodiments may use integrated circuit components such a memory, a processor, logic, and a look-up table, which may execute various functions by control of at least one microprocessor or other control devices. As the inventive features may be embodied by software programming or software components, these features may be realized through programming languages such as C, C++, Java, and assembly language or scripting language, with diverse algorithms realized with data structures, processors, routines, or other programming components. Functional aspects may be realized with an algorithm executed by at least one processor. In addition, the inventive features may be embodied in electronic circuitry, signal processing techniques, and/or data processing techniques. Terms such as mechanism, components, means, and configuration may be broadly used and are not limited to mechanical and physical components. These terms may mean a series of routines of software in connection to a processor.

Hereinafter, embodiments are described in more detail with reference to the accompanying drawings, where like reference numerals in the drawings generally denote like elements. In addition, some redundant descriptions are omitted.

FIG. 1 is a schematic diagram illustrating a structure of an organic electroluminescent display apparatus 100 according to an embodiment.

Referring to FIG. 1, the organic electroluminescent display apparatus 100 includes a timing control unit 110, a data drive unit 120, a gate drive unit 130, a pixel unit 140, and a power supply unit 150. The timing control unit 110 controls the data drive unit 120 and the gate drive unit 130. The data drive unit 120 outputs data signals corresponding to input images to respective pixels 142 through data lines D1 to Dm. The gate drive unit 130 outputs scan signals to the respective pixels 142 through scan lines S1 to Sn and outputs emission control signals through emission control lines E1 to En. The pixel unit 140 includes the pixels 142 connected to the scan lines S1 to Sn, the emission control lines E1 to En, and the data lines D1 to Dm. The power supply unit 150 generates a first power voltage ELVDD and a second power voltage ELVSS and outputs them to the respective pixels 142. In addition, the organic electroluminescent display apparatus 100 includes a battery voltage detecting unit 170, a temperature detecting unit 180, and an external light detecting unit 190.

The pixel unit 140 includes the pixels 142 near intersection points of the scan lines S1 to Sn, the emission control lines E1 to En, and the data lines D1 to Dm. The pixels 142 may be arranged in an m×n matrix as shown in FIG. 1. Each of the pixels 142 includes a light emitting device and receives the first power voltage ELVDD and the second power voltage ELVSS. Moreover, each of the pixels 142 supplies drive current or voltage to its light emitting device to cause it to emit light with a brightness corresponding to a data signal. According to an embodiment, the light emitting device is an organic light emitting diode (OLED).

Each of the pixels 142 controls an amount of current for the OLED in response to a data signal transmitted through the data lines D1 to Dm. The current is supplied from the first power voltage ELVDD to the second power voltage ELVSS through the OLED. In this embodiment, in response to the emission control signal transmitted through the emission control lines E1 to En, light of the brightness corresponding to the data signal is emitted from the OLED. Some embodiments do not have emission control lines for the pixels. In such embodiments, the pixels similarly control the brightness of the OLEDs with current supplied from the pixels.

The timing control unit 110 generates RGB Data and a data drive unit control signal DCS and outputs them to the data drive unit 120. The timing control unit 110 also generates a gate drive unit control signal SCS and outputs the gate drive unit control signal SCS to the gate drive unit 130. In addition, the timing control unit 110 outputs the RGB Data to a power voltage control unit 160. In this embodiment, the RGB Data represents data in which an input image is formatted with an RGB format. In alternative embodiments the input image is input with one or more other formats, different from the RGB format.

The data drive unit 120 generates data signals based on the RGB Data and outputs the data signals to the pixels 142 through the data lines D1 to Dm. The data drive unit 120 may generate a data signal from the RGB Data by using a gamma filter, a digital-analog converter, and so forth. In this embodiment, data signal are output to each of pixels 142 in the same row during a horizontal cycle. Moreover, in this embodiment, each of the data lines D1 to Dm for delivering data signals may be connected to pixels 142 in the same column. Other configurations may also be used.

The gate drive unit 130 generates scan signals and emission control signals based on the gate drive unit control signal SCS and outputs the scan signals and the emission control signals to each of the pixels 142 through the scan lines S1 to Sn and the emission control lines E1 to Em, respectively. In this embodiment, each of the scan lines S1 to Sn and each of the emission control lines E1 to En are connected to pixels 142 in the same row. Other configurations may also be used. The scan lines S1 to Sn and the emission control lines E1 to En sequentially or simultaneously output respective scan signals and emission control signals for each row. According to some embodiments of the organic electroluminescent display apparatus 100, the gate drive unit 130 generates one or more additional drive signals and outputs the additional drive signals to each of the pixels 142.

The power supply unit 150 generates a first power voltage ELVDD and a second power voltage ELVSS, for example, from an external power supply (not shown) and delivers the first and second power voltages ELVDD and ELVSS to each of the pixels 142 through a first power supply line L1 and a second power supply line L2, respectively. The first power voltage ELVDD and the second power voltage ELVSS are used for driving each of the pixels 142. The power supply unit 150 may include a DC-DC converter.

The battery voltage detecting unit 170 detects a voltage Vbat of a battery (not shown) for supplying power to the organic electroluminescent display apparatus 100 and provides information about the battery voltage Vbat to the data drive unit 120.

The temperature detecting unit 180 measures a temperature T of the organic electroluminescent display apparatus 100 and then provides information about the temperature T to the power voltage control unit 160.

The external light detecting unit 190 detects brightness LU of ambient light of the organic electroluminescent display apparatus 100 and provides information about the brightness LU of the ambient light to the data drive unit 120.

The power voltage control unit 160 controls a first power voltage ELVDD and/or a second power voltage ELVSS of the organic electroluminescent display apparatus 100 based on a combination of the temperature T, the battery voltage Vbat, the information about the brightness LU, and the RGB data.

Figure 2:
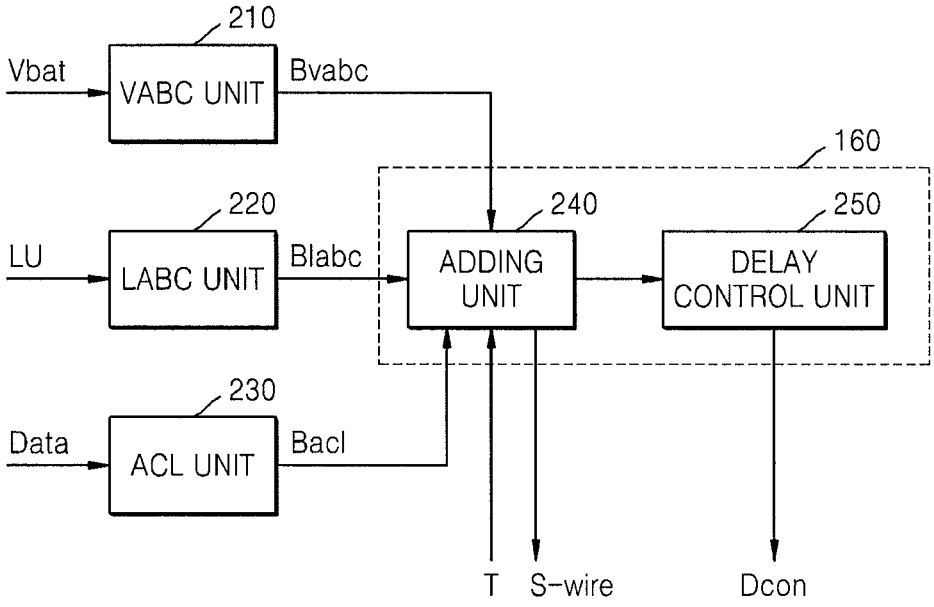
FIG. 2 is a schematic diagram illustrating some components of an organic electroluminescent display apparatus according to an embodiment.

Referring to FIG. 2, a structure of the power voltage control unit 160 is described in more detail.

FIG. 2 is a schematic diagram illustrating various components of the organic electroluminescent display apparatus 100, according to an embodiment.

Referring to FIG. 2, the organic electroluminescent display apparatus 100 includes a battery voltage-based brightness control unit (VABC unit) 210, an external light-based brightness control unit (LABC unit) 220, and an input image-based brightness control unit (ACL unit) 230. In some embodiments, the VABC unit 210 and the LABC unit 220 are integrated with the Data Drive Unit 120.

The VABC 210 receives information about a battery voltage Vbat and adjusts the brightness of the organic electroluminescent display apparatus 100 according to the information. If the battery voltage Vbat is low, meaning that remaining power of a battery is low, the brightness of the organic electroluminescent display apparatus 100 is reduced in order to save power. Hereinafter, the brightness adjustment of the organic electroluminescent display apparatus 100 according to the battery voltage Vbat is designated as VABC.

The LABC 220 receives information about brightness LU of ambient light and adjusts the brightness of the organic electroluminescent display apparatus 100 according to the information. If the brightness LU of ambient light is low, the brightness level of the organic electroluminescent display apparatus 100 needed by a user to recognize a display image, is low. Accordingly, if the brightness LU of ambient light is low, the brightness of the organic electroluminescent display apparatus 100 is reduced to save power. Hereinafter, the brightness adjustment of the organic electroluminescent display apparatus 100 according to the brightness LU of ambient light is designated as LABC. Moreover, the brightness adjustment means adjusting the brightness of the organic electroluminescent display apparatus 100.

The brightness adjustment VABC in the VABC unit 210 and the brightness adjustment LABC in the LABC unit 220 are designated as an automatic brightness control (ABC).

The ACL unit 230 controls brightness by limiting a drive current of each of the pixels 142 according to image Data (Automatic Current Limit (ACL)) in this embodiment. When an input image of a frame has high brightness, the ACL unit 230 limits the drive current of each pixel in order to reduce power consumption of the organic electroluminescent display apparatus 100, thereby reducing the brightness of the displayed frame. For example, the ACL unit 230 may sum up data values of the pixels for an input image of one frame and determine average brightness. The ACL unit 230 may adjust a level of a data signal generated from the data drive unit 120 or RGB Data of an input image according to the average brightness. The ACL unit 230 may be included in a separate block or may be included in the data drive unit 120 when a method of adjusting a level of a data signal is used.

The power voltage control unit 160 receives brightness control signals Bvabc, Blabc, and Bacl from the VABC unit 210, the LABC unit 220, and the ACL unit 230, respectively, and generates a power voltage control signal S-wire to control the first and/or second power voltage ELVDD and/or ELVSS. The power supply unit 150 of FIG. 1 adjusts the first and/or second power voltage ELVDD and/or ELVSS according to the power voltage control signal S-wire. The power voltage control unit 160 may include an adding unit 240 and a delay control unit 250.

The adding unit 240 generates the power voltage control signal S-wire based on a VABC brightness control signal Bvabc determined by the VABC unit 210, an LABC brightness control signal Blabc determined by the LABC unit 220, an ACL brightness control signal Bacl determined by the ACL unit 230), and information about temperature T detected by the temperature detecting unit 180. The power voltage control signal S-wire may be determined by applying different weights to the VABC brightness control signals Bvabc, Blabc, Bad, and the temperature T to obtain linear combination. If the power voltage control signal S-wire is defined by a number of pulses, the power voltage control signal S-wire may be defined according to the following Equation 1.

$$S\text{-wire pulse}=\text{temperature } S\text{-wire pulse}+(VABC\ S\text{-wire pulse}+LABC\ S\text{-wire pulse}+ACL\ S\text{-wire pulse}) \quad \text{[Equation 1]}$$

where temperature S-wire pulse is determined by the temperature T, VABC S-wire pulse is determined by the VABC brightness control signal Bvabc, LABC S-wire pulse is determined by the LABC brightness control signal Blabc, and ACL S-wire pulse is determined by the ACL brightness control signal Bad.

Each S-wire pulse may be defined according to the following Equation 2.

$$\text{temperature } S\text{-wire pulse}=T__SWIRE_STEP\times\text{temperature } T$$

$$VABC\ S\text{-wire pulse}=VABC__SWIRE_STEP\times VABC\ \text{brightness control signal}$$

$$LABC\ S\text{-wire pulse}=LABC__SWIRE_STEP\times LABC\ \text{brightness control signal}$$

$$ACL\ S\text{-wire pulse}=ACL__SWIRE_STEP\times ACL\ \text{brightness control signal} \quad \text{[Equation 2]}$$

where T_SWIRE_STEP is a temperature weight, VABC_SWIRE_STEP is a VABC weight, LABC_SWIRE_STEP is an LABC weight, and ACL_SWIRE_STEP is an ACL weight.

The weights can have various relative relationships. For example, the T_SWIRE_STEP, in some embodiments, can vary between 0 and 31, and in some embodiments, is equal to 14. VABC_SWIRE_STEP, in some embodiments, can vary between 0 and 7, and in some embodiments, is equal to 3. LABC_SWIRE_STEP, in some embodiments, can vary between 0 and 7, and in some embodiments, is equal to 3. ACL_SWIRE_STEP, in some embodiments, can vary between 0 and 3, and in some embodiments, is equal to 2.

In some embodiments, by applying different weights to adjust the first and/or second power voltage ELVDD and/or ELVSS, the first and/or second power voltage ELVDD and/or ELVSS may be effectively adjusted in order to maintain excellent quality of an image displayed by the pixel unit 140 and reduce power consumption effectively.

The temperature S-wire pulse may be configured to increase a voltage difference (hereinafter, referred to as a power voltage difference) between the first power voltage ELVDD and the second power voltage ELVSS as the temperature T decreases. The VABC S-wire pulse may be configured to decrease a power voltage difference as the level of the VABC brightness control signal Bvabc decreases. The ACL S-wire pulse may be configured to decrease a power voltage difference as the level of the ACL brightness control signal Bacl decreases. The temperature T, Bvabc, Blabc, and Bad may be quantized values. A value of the S-wire pulse may be represented with the number of pulses.

As one example, according to an embodiment, each weight may be configured to have a weight relationship of VABC weight>temperature weight>LABC weight>ACL weight. If a battery has little remaining power, power consumption needs to be reduced drastically in order to increase usage time of the organic electroluminescent display apparatus 100.

Therefore, the VABC weight is set with the highest value. If temperature is low, since characteristics of transistors and OLEDs in the organic electroluminescent display apparatus 100 change, the temperature weight is set with a relatively high value in order to prevent image quality deterioration due to the temperature. Since controlling of the first and/or second power voltage ELVDD and/or ELVSS by LABC and ACL is related to functions for saving power, the LABC weight and ACL weight may be configured with relatively lower values than the VABC weight and temperature weight, respectively.

As stated above, the calculated S-wire pulse may be output to the power supply unit 150, and the power supply unit 150 may adjust the first and/or second power voltage ELVDD and/or ELVSS according to the S-wire pulse.

Figure 3:
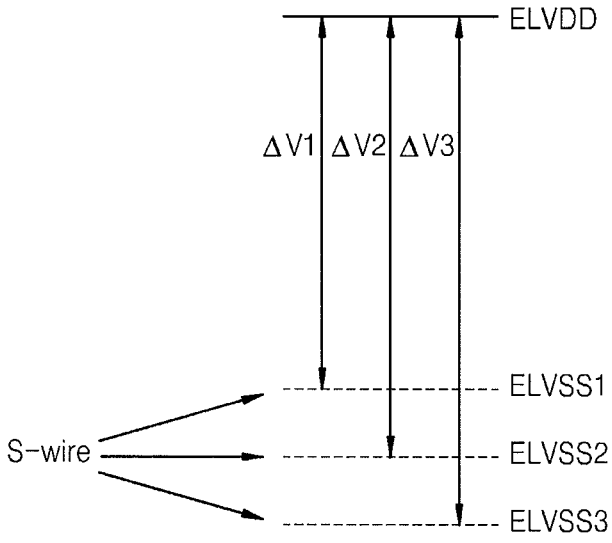
FIG. 3 is a graphical representation of an example of the control of a first power voltage ELVDD and/or a second power voltage ELVSS, according to an embodiment.

FIG. 3 is a graphical representation of an example of controlling the first power voltage ELVDD and/or the second power voltage ELVSS, according to an embodiment.

According to some embodiments, the power voltage difference is adjusted by controlling the first and/or the second power voltage ELVDD and/or ELVSS according to a power voltage control signal S-wire. Either the first power voltage ELVDD or the second power voltage ELVSS, or both of the first power voltage ELVDD and the second power voltage ELVSS may be modified. FIG. 3 illustrates an example in which the power voltage difference is adjusted by controlling the second power voltage ELVSS according to the power voltage control signal S-wire.

As shown in FIG. 3, the power supply unit 150 may control the voltage level of the second power voltage ELVSS according to the power voltage control signal S-wire.

The voltage level of the second power voltage ELVSS is determined according to the power voltage control signal S-wire and thus, the power voltage difference is adjusted. For example, the power supply unit 150 may set the second power voltage ELVSS to one level of ELVSS1, ELVSS2, and ELVSS3 according to the power voltage control signal S-wire and thus, the power voltage difference may be adjusted to be ΔV1, ΔV2, or ΔV3.

The delay control unit 250 determines timing and sequencing of brightness adjustment and power voltage difference adjustment according to what triggers the power voltage difference adjustment. The power supply unit 150 and the data drive unit 120 adjust the brightness and power voltage difference according to the timing and sequencing of brightness and power voltage difference adjustments. The timing and sequencing is determined by a delay control signal Dcon generated by the delay control unit. In one example, if brightness reduction is triggered by the ABC function, the organic electroluminescent display apparatus 100 reduces brightness first and then reduces a power voltage difference after the brightness reaches a target level. In another case, if brightness increase is triggered by the ABC function, the organic electroluminescent display apparatus 100 increases a power voltage difference first and then increases brightness after the power voltage difference reaches a target level. Furthermore, if the brightness and power voltage difference adjustments are triggered by the ACL function, the organic electroluminescent display apparatus 100 may perform the brightness and the power voltage difference adjustments simultaneously without a delay. According to some embodiments, power voltage difference adjustment according to a temperature may be performed without a delay.

Figure 4:
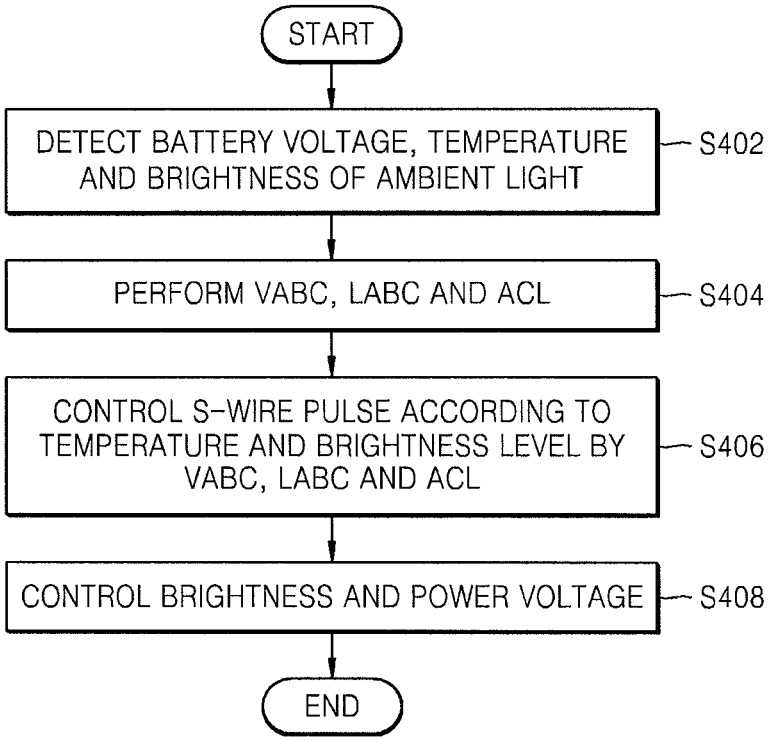
FIG. 4 is a flowchart illustrating a method of driving the organic electroluminescent display apparatus of FIG. 1, according to an embodiment.

FIG. 4 is a flowchart illustrating a method of driving the organic electroluminescent display apparatus 100 of FIG. 1, according to an embodiment.

The battery voltage detecting unit 170 detects a battery voltage Vbat, the temperature detecting unit 180 detects a temperature T, and the external light detecting unit 190 detects brightness LU of ambient light, in operation S402. Next, the VABC unit 210 generates a VABC brightness control signal Bvabc according to a battery voltage Vbat, the LABC unit 220 generates an LABC brightness control signal Blabc according to brightness LU of ambient light, and the ACL unit 230 generates an ACL brightness control signal Bacl according to an image data (e.g. RGB data), in operation 5404.

Next, the power voltage control signal S-wire is adjusted according to the VABC brightness control signal Bvabc, LABC brightness control signal Blabc, ACL brightness control signal Bacl, and temperature T. The power voltage control signal S-wire may be expressed as the above-defined Equation 1.

Once the power voltage control signal S-wire is generated, the order of brightness and power voltage difference adjustments is determined according to a factor that triggers the brightness and power voltage difference adjustments. Then, the brightness and power voltage difference are adjusted in operation 5408.

Examples of driving of the organic electroluminescent display apparatus 100, according to various embodiments are described with reference to FIGS. 5 to 8. FIGS. 5 to 8 are graphs illustrating power voltage difference control performed by adjusting the second power voltage ELVSS.

Figure 5:
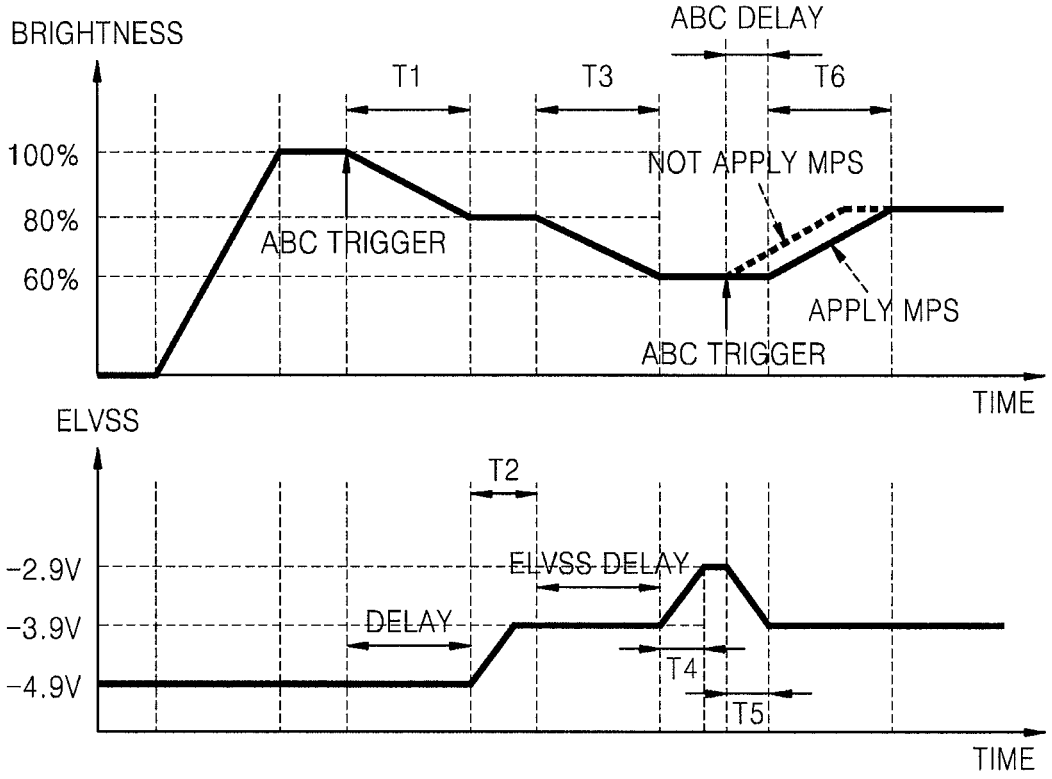
FIG. 5 is a set of graphs illustrating an example of the control of a brightness and a power voltage difference when the control of a brightness and a power voltage difference is triggered by an ABC function, according to an embodiment.

FIG. 5 is a set of graphs illustrating an example of controlling brightness and power voltage difference when the control of the brightness and the power voltage difference is triggered by an ABC function.

As illustrated in FIG. 5, if the brightness reduction is triggered by an ABC (the first ABC trigger) function, both the brightness and the power voltage difference are reduced. In this case, the brightness is reduced, and the power voltage difference is reduced, where the power voltage difference is reduced after the brightness reduction. Instead of being reduced all at once, the operations of reducing the brightness and the power voltage difference may be performed multiple times as illustrated in FIG. 5. For example, as illustrated in FIG. 5, if the brightness is to decrease from 100% to 60% and the second power voltage ELVSS is to increase from −4.9V to −2.9V, the brightness decreases to an intermediate level (80% in FIG. 5) during a period T1, the second power voltage ELVSS increases to an intermediate level (−3.9V in FIG. 5) during a period T2, the brightness then decreases to a target level (60% in FIG. 5) during a period T3 and the second power voltage ELVSS increases to a target level (−2.9V in FIG. 5) during a period T4. This driving method can prevent the user from experiencing a sudden visual change. If the difference between the current brightness value and the target brightness value is equal to or greater than a value, the control of the brightness and the power voltage difference may be performed multiple times; and if the difference between the current brightness value and the target brightness value is less than the value, the control of the brightness and the power voltage difference may be performed only one time.

As illustrated in FIG. 5, if the brightness increase is triggered by an ABC (the second ABC trigger) function, both the brightness and the power voltage difference are increased. In this case, the power voltage difference is increased, and the brightness is increased after completion of the power voltage difference increase. For example, as illustrated in FIG. 5, the second power voltage ELVSS decreases during a period T5 and then the brightness increases during a period T6. As illustrated in FIG. 5 by the dashed brightness line, if the delay is not applied, the brightness is controlled immediately after the brightness change is triggered by the ABC function. However, according to the embodiment of FIG. 5, the brightness control by the ABC function is performed after completion of the power voltage difference control. If the brightness decreases because of the ABC function, because there is a power voltage difference corresponding to the decreased brightness, the brightness is controlled and then the power voltage difference is controlled in accordance with a power voltage difference margin at the controlled brightness. However, if the brightness increases because of the ABC function, because the current power voltage difference is set in accordance with the brightness lower than the target brightness value, the image displayed on a screen of the pixel unit 140 is distorted when the brightness increases without increasing the power voltage difference. Thus, if the brightness increases because of the ABC function, the brightness increases after the power voltage difference increases in order to realize an appropriate power voltage difference margin. Also, because the ABC is performed by detecting the battery voltage Vbat or the brightness of the ambient light, if the brightness control and the power voltage difference control are performed by the ABC function, the brightness value of the ambient light or the battery voltage Vbat is detected and a delay is added before adjusting the brightness.

Figure 6:
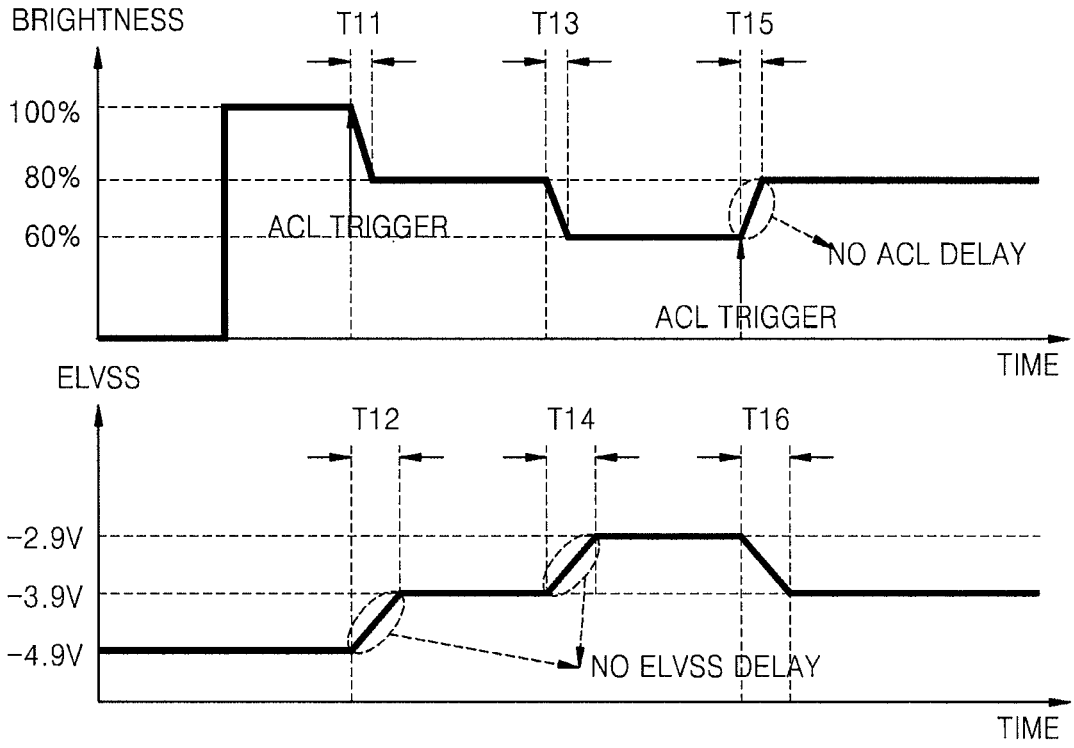
FIG. 6 is a set of graphs illustrating an example of the control of a brightness and a power voltage difference when the control of a brightness and a power voltage difference is triggered by an ACL function, according to an embodiment.

FIG. 6 is a set of graphs illustrating an example of controlling the brightness and power voltage difference triggered by an ACL function.

As illustrated in FIG. 6, if the brightness increase/decrease is triggered by an ACL function (the first ACL trigger of FIG. 6), the brightness and the power voltage difference can change together without generating a delay in the brightness control or the power voltage difference control. For example, when the brightness decrease is triggered by the ACL function, the brightness decreases during a period T11 and the second power voltage ELVSS increases during a period T12. In FIG. 6, the brightness and the power voltage difference decrease multiple times in response to the first ACL trigger. As shown, after the brightness and the power voltage difference decrease once in the periods T11 and T12, the brightness and the power voltage difference decrease a second time during periods T13 and T14. Thereafter, because of the second ACL trigger of FIG. 6, the brightness increases during a period T15 and the second power voltage ELVSS decreases during a period T16.

Figure 7:
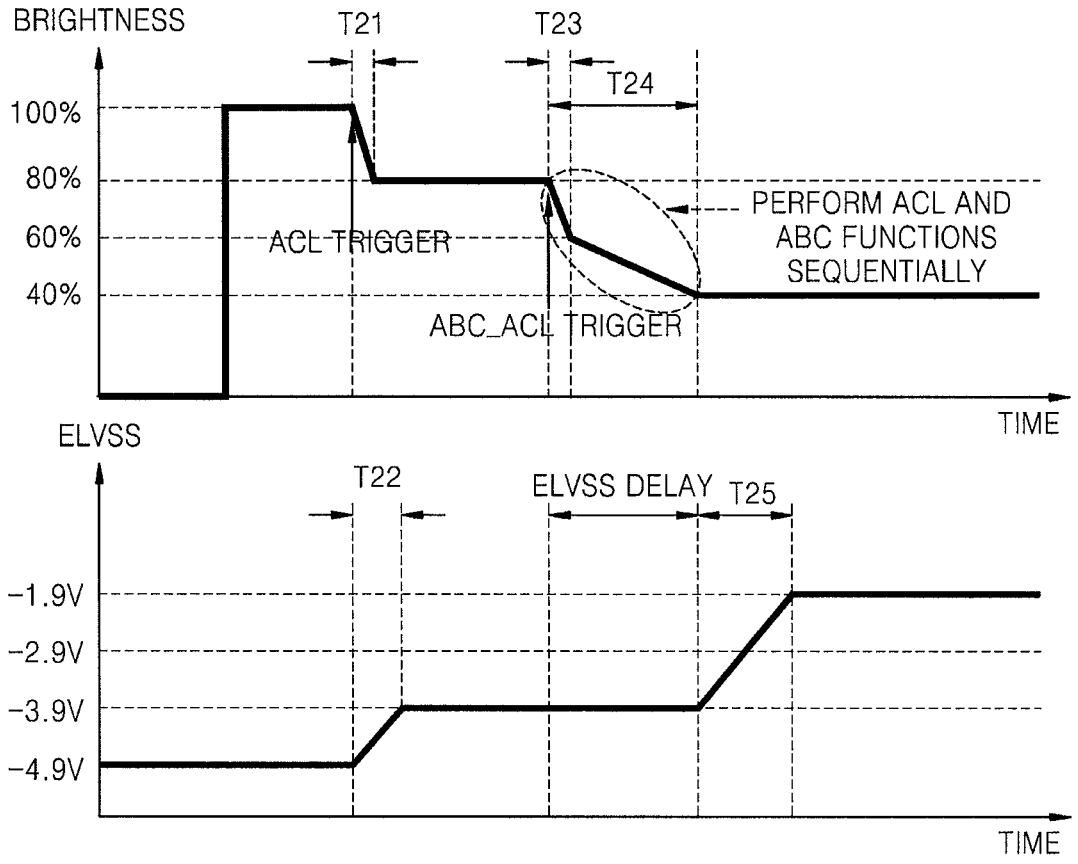
FIG. 7 is a set of graphs illustrating an example of the control of a brightness and a power voltage difference when the control of a brightness and a power voltage difference is triggered by an ABC function and an ACL function, according to an embodiment.

FIG. 7 is a set of graphs illustrating an example of controlling the brightness and the power voltage difference if the control of a brightness and a power voltage difference is triggered by both ABC and ACL functions.

As described above, if the brightness change is triggered by the ACL function (the first ACL trigger of FIG. 7), a delay does not occur in the brightness control and the power voltage difference control. In this example, the brightness changes during a period T21 and the second power voltage ELVSS changes during a period T22.

Thereafter, if the brightness change is triggered by the ABC and the ACL functions (the ABC_ACL trigger of FIG. 7), the brightness change trigger causes a delay in the control of the brightness or the power voltage difference. For example, as illustrated in FIG. 7, if the brightness decrease is triggered by the ABC and the ACL functions (the ABC_ACL trigger of FIG. 7), the brightness decreases because of the ACL function during a period T23 and the brightness decreases because of the ABC function during a period T24. FIG. 7 illustrates the case where the brightness change because of the ACL function and the brightness change because of the ABC function are performed sequentially, but this is merely exemplary, and the brightness change by the ACL function and the brightness change by the ABC function may be performed simultaneously or in the other sequence. As shown, the second power voltage ELVSS increases after completion of the brightness change because of the ACL function and after completion of the brightness change because of the ABC function.

According to some embodiments, the brightness control and the power voltage difference control are sequentially performed if the brightness change is triggered by the ABC function; and the brightness control and the power voltage difference control are simultaneously performed without delay if the brightness change is triggered by the ACL function. The ACL function may initiate the brightness control by modifying the input image to each pixel 142 and controlling the output data signal from the data drive unit 120. In this case, because the ABC function has a more significant visual effect on the brightness control, if the brightness change is triggered by the ABC function, the brightness change and the power voltage difference control are performed not simultaneously but sequentially in order to prevent the user from experiencing a sudden brightness change.

Figure 8:
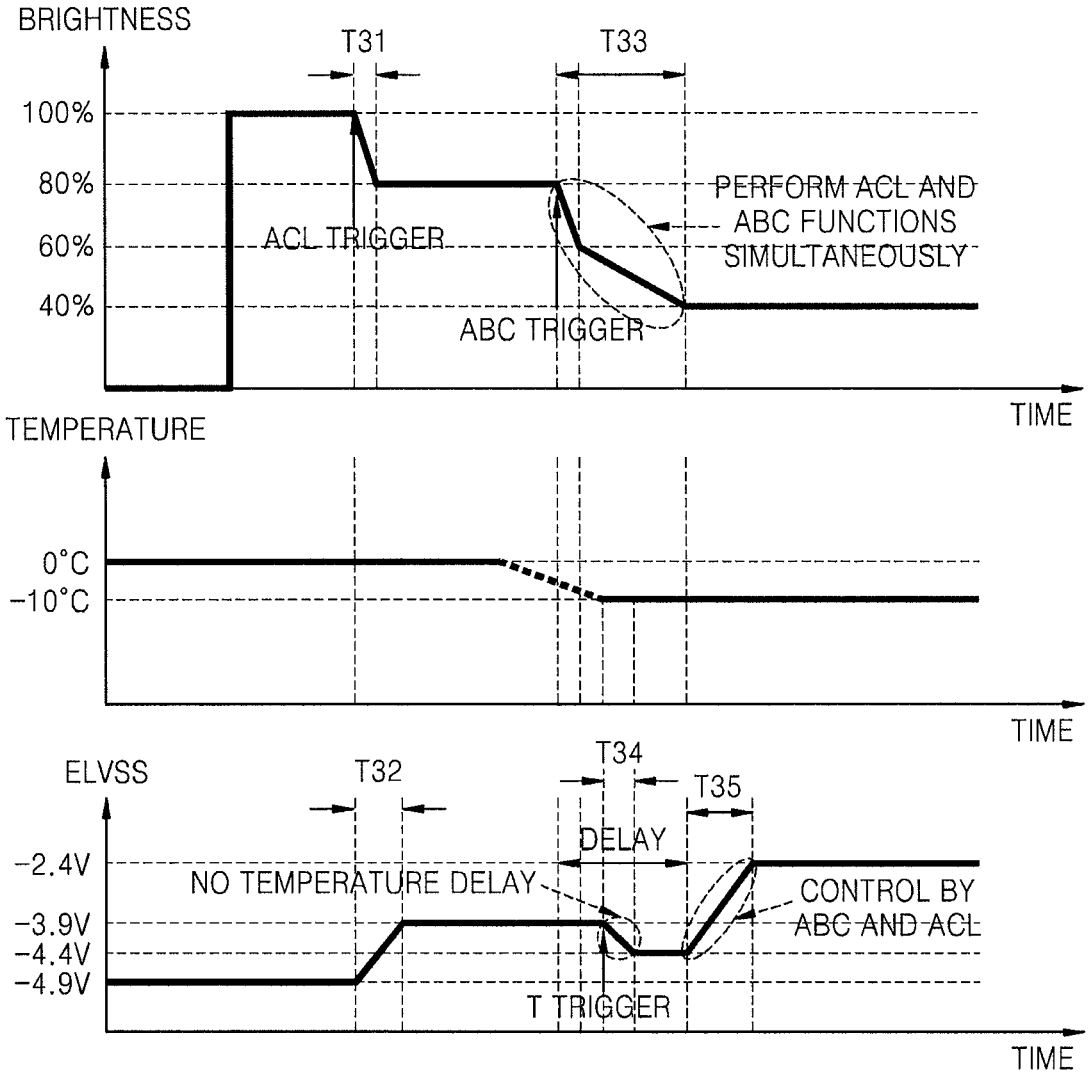
FIG. 8 is a set of graphs illustrating an example of the control of a brightness and a power voltage difference when a brightness change and a power voltage difference change is triggered by an ACL function, an ABC function and a temperature T, according to an embodiment.

FIG. 8 is a set of graphs illustrating an example of controlling brightness and power voltage difference when the brightness and power voltage difference change is triggered by an ACL function, an ABC function, and a temperature T.

As described above, if the brightness change is triggered by the ACL function (the ACL trigger of FIG. 8), a delay does not occur in the brightness control or the power voltage difference control. The brightness changes during period T31 and the second power voltage ELVSS changes during period T32. In the embodiment of FIG. 8, because the brightness change by the ACL function is equal to or greater than a reference value, the power voltage difference control and the brightness change by the ACL function are performed multiple times. As illustrated in FIG. 8, the brightness change by the ABC function may be triggered during the multiple-time ACL function control (the ABC trigger of FIG. 8). In this case, the second brightness decrease by the ACL function and the brightness decrease by the ABC function may be sequentially performed during a period T33. Also, because the brightness decrease is triggered by the ABC function, a delay occurs in the power voltage difference control so that the second power voltage ELVSS increases during a period T35 after completion of the brightness decrease by the ABC function. However, as illustrated in FIG. 8, if the brightness change and the power voltage difference change are triggered by the ABC function and the power voltage difference change is triggered by the temperature change during the delay of the power voltage difference change (the period T33) (the T trigger of FIG. 8), the power voltage difference control caused by the temperature change is performed immediately. The power voltage difference control caused by the temperature change is for preventing the image quality from degrading due to a change in the characteristics of transistors or OLEDs. Therefore, the power voltage difference control is performed with a high weight and without delay.

According to various embodiments, the power voltage difference is controlled according to the VABC, LABC and ACL operations, thereby increasing the power consumption reduction effect. The relative levels of influences of the VABC, LABC, ACL operations, and temperature on the power voltage difference control are differently applied according to weights for each. As a result, power consumption is reduced without causing image quality degradation.

As described above, various embodiments greatly reduce the power consumption of an organic electroluminescent display apparatus by simultaneously controlling the brightness of the organic electroluminescent display apparatus and a first power voltage and/or a second power voltage supplied to each pixel of the organic electroluminescent display apparatus.

Also, the embodiments prevent image quality degradation and decrease power consumption by applying different weights to the effects of temperature, battery voltage, brightness of ambient light, and brightness of the input image in controlling the first and/or second power voltage(s) supplied to the pixels of the organic electroluminescent display apparatus.

Also, the embodiments prevent the user from experiencing a sudden visual change in brightness, by adding a delay in the control of the brightness and the first and/or second power voltage(s). The delay is dependent on the factor that triggers the control of the first and/or second power voltage(s).

While various inventive aspects have been particularly shown and described with reference to exemplary embodiments, it will be understood by those of ordinary skill in the art that various changes in form and details may be made to the described embodiments.

What is claimed is:

1. A method of driving an organic electroluminescent display apparatus, comprising:

detecting a voltage of a battery that supplies power to the organic electroluminescent display apparatus;

detecting a brightness of ambient light;

detecting a temperature of the organic electroluminescent display apparatus; and controlling a brightness of the organic electroluminescent display apparatus and a voltage difference between a first power voltage and a second power voltage that are supplied to pixels of the organic electroluminescent display apparatus, wherein the brightness and the power voltage difference are controlled according to a pulsed power voltage control signal based on the battery voltage, the brightness of the ambient light, the temperature, and image data of the organic electroluminescent display apparatus, wherein the controlling the brightness and the power voltage difference comprises:

determining a pulsed voltage-based automatic brightness control (VABC) brightness control signal according to the battery voltage;

determining a pulsed light-based automatic brightness control (LABC) brightness control signal according to the brightness of the ambient light;

determining a pulsed automatic current limit (ACL) brightness control signal according to the image data;

generating the pulsed power voltage control signal to control the power voltage difference by adding the pulsed VABC brightness control signal, the pulsed LABC brightness control signal, the pulsed ACL brightness control signal, and a pulsed control signal determined by the temperature; and controlling the power voltage difference and the brightness of the organic electroluminescent display apparatus according to the pulsed power voltage control signal, wherein the generating the pulsed power voltage control signal includes applying different weights to the pulsed VABC brightness control signal, the pulsed LABC brightness control signal, the pulsed ACL brightness control signal, and the pulsed control signal determined by the temperature and linearly combining the pulsed VABC brightness control signal, the pulsed LABC brightness control signal, the pulsed ACL brightness control signal, and the pulsed control signal determined by the temperature according to the applied weights to generate the pulsed power voltage control signal.

2. The method of claim 1, wherein the VABC weight of the VABC brightness control signal, the LABC weight of the LABC brightness control signal, the ACL weight of the ACL brightness control signal, and the temperature weight of the temperature have a relationship such that VABC Weight>Temperature Weight>LABC Weight>ACL Weight.

3. The method of claim 1, wherein the controlling at least one of the power voltage difference and the brightness of the organic electroluminescent display apparatus comprises:

determining a factor triggering the power voltage difference control and the brightness control of the organic electroluminescent display apparatus, among the battery voltage, the brightness of the ambient light, the image data, and the temperature;

determining a delay in the brightness control and the power voltage difference control according to the trigging factor; and controlling the power voltage difference and the brightness of the organic electroluminescent display apparatus according to the delay.

4. The method of claim 3, wherein if the triggering factor is the battery voltage or the brightness of the ambient light, one of the brightness control and the power voltage difference control is performed prior to the other of the brightness control and the power voltage difference control.

5. The method of claim 4, wherein:

if the triggering factor is the battery voltage or the brightness of the ambient light and if the brightness is to be reduced, the brightness control is performed prior to the power voltage difference control; and if the triggering factor is the battery voltage or the brightness of the ambient light and if the brightness is to be increased, the brightness control is performed after the power voltage difference control.

6. The method of claim 3, wherein if the triggering factor is the image data or the temperature, the brightness control and the power voltage difference control are performed simultaneously.

7. The method of claim 1, wherein the controlling the brightness of the organic electroluminescent display apparatus comprises modifying a data signal supplied to each pixel of the organic electroluminescent display apparatus according to the VABC brightness level or the LABC brightness level.

8. The method of claim 1, wherein if the difference between a start brightness value and a target brightness value is equal to or greater than a reference value the brightness control and the power voltage difference control are performed multiple times.

9. The method of claim 1, wherein a change in the temperature affects only the power voltage difference control, and not the brightness control of the organic electroluminescent display apparatus.

10. An organic electroluminescent display apparatus comprising:

a plurality of pixels disposed near intersections between data lines and scan lines;

a gate control unit configured to output scan signals through the scan lines to the pixels and to output an emission control signal through emission control lines to the pixels;

a data drive unit configured to generate a data signal corresponding to image data and to output the data signal through the data lines to the pixels;

a battery voltage detecting unit configured to detect a voltage of a battery that supplies power to the organic electroluminescent display apparatus;

a power supply unit configured to generate and output a first power voltage and a second power voltage directly to the pixels;

an external light detecting unit connected only to the data drive unit, the external light detecting unit configured to detect a brightness of ambient light;

a temperature detecting unit configured to detect a temperature of the organic electroluminescent display apparatus;

a power voltage control unit connected to the battery voltage detecting unit, the power voltage control unit configured to control a brightness of the organic electroluminescent display apparatus and a voltage difference between the first power voltage and the second power voltage according to the battery voltage, the brightness of the ambient light, the temperature, and the image data;

a battery voltage-based brightness control unit configured to determine a pulsed voltage-based automatic brightness control (VABC) brightness control signal according to the battery voltage;

an external light-based brightness control unit configured to determine a pulsed light-based automatic brightness control (LABC) brightness control signal according to the brightness of the ambient light; and an input image-based current limiting unit configured to determine a pulsed automatic current limit (ACL) brightness control signal according to the image data, wherein the power voltage control unit controls the power voltage difference and the brightness of the organic electroluminescent display apparatus according to the pulsed VABC brightness control signal, the pulsed LABC brightness control signal, the pulsed ACL brightness control signal, and the temperature, wherein the power supply unit controls the power voltage difference according to the control of the power voltage control unit, and wherein the data driving unit controls the brightness of the organic electroluminescent display apparatus according to the pulsed VABC brightness control signal, the pulsed LABC brightness control signal, the pulsed ACL brightness control signal, and the control of the power voltage difference, wherein the power voltage control unit comprises an adding unit configured to apply different weights to the pulsed VABC brightness control signal, the pulsed LABC brightness control signal, the pulsed ACL brightness control signal, and the pulsed control signal determined by the temperature and to linearly combine the weighted pulsed VABC brightness control signal, the weighted pulsed LABC brightness control signal, the weighted pulsed ACL brightness control signal, and the weighted pulsed control signal determined by the temperature to generate a pulsed power voltage control signal for controlling the power voltage difference.

11. The organic electroluminescent display apparatus of claim 10, wherein the VABC weight of the VABC brightness control signal, the LABC weight of the LABC brightness control signal, the ACL weight of the ACL brightness control signal, and the temperature control signal of the temperature have a relationship such that VABC Weight>Temperature Weight>LABC Weight>ACL Weight.

12. The organic electroluminescent display apparatus of claim 10, wherein the power voltage control unit comprises a delay control unit configured to determine a factor triggering the power voltage difference control and the brightness control of the organic electroluminescent display apparatus, among the battery voltage, the brightness of the ambient light, the image data, and the temperature, to determine a delay for at least one of the brightness control and the power voltage difference control according to the trigging factor, and to control the power voltage difference and the brightness of the organic electroluminescent display apparatus according to the delay.

13. The organic electroluminescent display apparatus of claim 12, wherein if the triggering factor is the battery voltage or the brightness of the ambient light, one of the brightness control and the power voltage difference control is performed prior to the other of the brightness control and the power voltage difference control.

14. The organic electroluminescent display apparatus of claim 13, wherein:

if the triggering factor is the battery voltage or the brightness of the ambient light and if the brightness is to be reduced, the brightness control is performed prior to the power voltage difference control; and if the triggering factor is the battery voltage or the brightness of the ambient light and if the brightness is to be increased, the brightness control is performed after the power voltage difference control.

15. The organic electroluminescent display apparatus of claim 13, wherein if the triggering factor is the battery voltage or the brightness of the ambient light, the data drive unit controls the brightness of the organic electroluminescent display apparatus by modifying the data signal according to the VABC brightness level or the LABC brightness level.

16. The organic electroluminescent display apparatus of claim 12, wherein if the triggering factor is the image data or the temperature, the brightness control and the power voltage difference control are performed simultaneously.

17. The organic electroluminescent display apparatus of claim 10, wherein if the difference between a start brightness value and a target brightness value is equal to or greater than a reference value the brightness control and the power voltage difference control are performed multiple times.

18. The organic electroluminescent display apparatus of claim 10, wherein a change in the temperature affects only the power voltage difference control, and not the brightness control of the organic electroluminescent display apparatus.

* * * * *